US007020973B2

(12) United States Patent
Knight, Jr.

(10) Patent No.: US 7,020,973 B2
(45) Date of Patent: Apr. 4, 2006

(54) TILE MARKING TOOL

(76) Inventor: David Knight, Jr., 3260 Ideal Ave. NE, Palm Bay, FL (US) 32905

( * ) Notice: Subject to any disclaimer, the term of this patent is extended or adjusted under 35 U.S.C. 154(b) by 56 days.

(21) Appl. No.: 10/919,500

(22) Filed: Aug. 17, 2004

(65) Prior Publication Data

US 2006/0037207 A1 Feb. 23, 2006

(51) Int. Cl.
*G01B 5/24* (2006.01)

(52) U.S. Cl. ..... 33/526; 33/561.1; 33/552

(58) Field of Classification Search ..... 33/526–527, 33/561.1, 561.2, 561.3, 552
See application file for complete search history.

(56) References Cited

U.S. PATENT DOCUMENTS

| | | | | |
|---|---|---|---|---|
| 2,445,324 | A * | 7/1948 | Greenwell | 33/561.1 |
| 2,785,472 | A * | 3/1957 | Elkin | 33/561.3 |
| 5,241,756 | A * | 9/1993 | King | 33/561.1 |
| 6,101,730 | A * | 8/2000 | Marino | 33/526 |

* cited by examiner

*Primary Examiner*—Yaritza Guadalupe

(57) ABSTRACT

The invention is a device used to measure and mark floor tile that must be cut to fit around obstructions. A key feature of the invention is that it has removable elements that make it possible to use the device with tile of any size. A second key feature is a plurality of telescoping members that can be extended to varying lengths in order to describe the perimeter geometry that must be duplicated by cutting away a portion of the tile. The invention is compatible with all tile and similar flat floor or wall coverings, such as pavers or carpet squares.

7 Claims, 11 Drawing Sheets

Fig.1
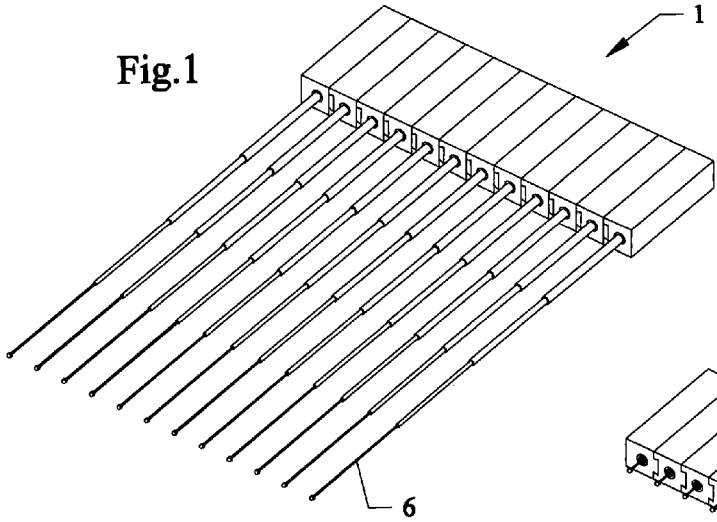
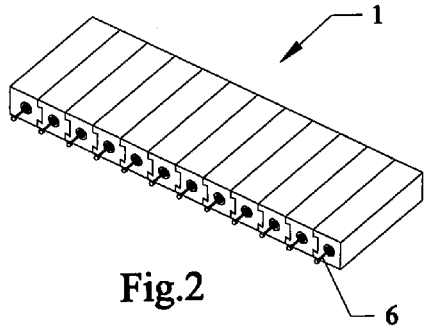
Fig.2

Fig.7
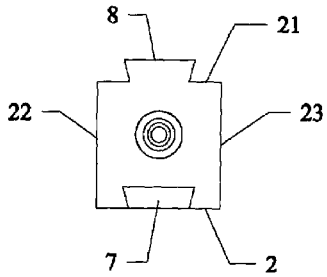
Fig.8
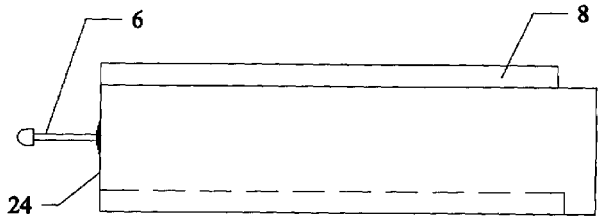
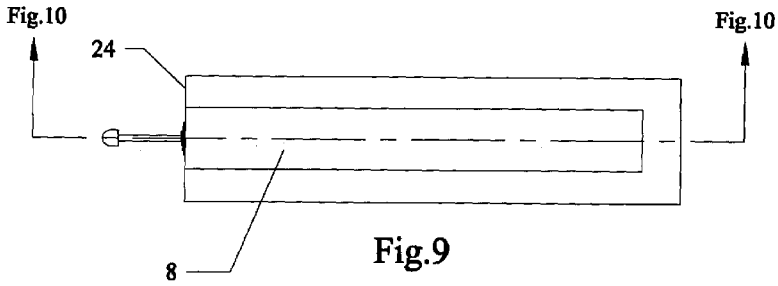
Fig.9

Fig.10A
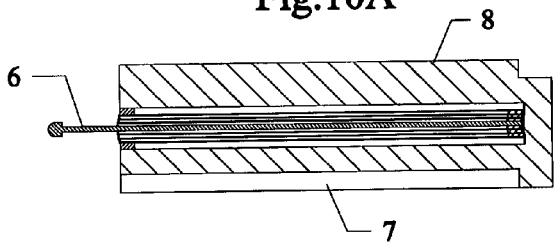
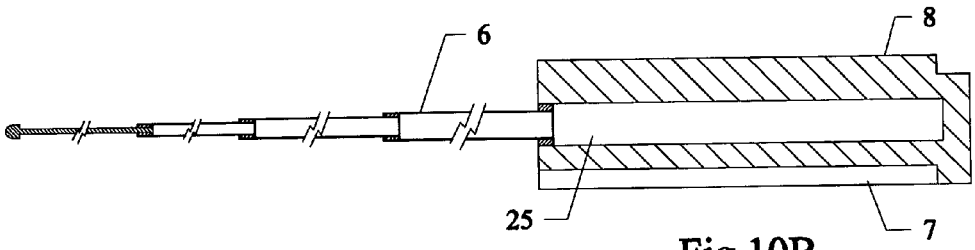
Fig.10B

TILE MARKING TOOL

BACKGROUND OF THE INVENTION

1. Field of the Invention

The present invention relates to the field of laying floor tile, pavers, and the like. Specifically, the invention relates to devices used to assist measuring and cutting floor tile prior to installation.

2. Description of the Prior Art

Laying floor tile is a craft that requires a great deal of trial and error to master. Tile must be cut to fit around obstacles, such as moulding, doorways, and structural features of the surface to be tiled. Cutting tiles is an inexact technique often requiring repeated attempts to nibble or wet-saw portions of a tile away until the proper shape results. Considerable waste is generated from mis-cut tiles and from tiles that break as a result of repeated manipulations with nippers or a wet saw. This iterative process is also very time-consuming and frustrating for all but the most skilled craftsmen. What is needed, but not found in the prior art, is a universal device that can be used to translate any complex cutting geometry to any size tile so that a single cutting or nibbling step can produce an accurately cut tile for that same geometry.

SUMMARY OF THE INVENTION

The present invention is a device used to measure and mark floor tile that must be cut to fit around obstructions. A key feature of the invention is that it has removable elements that make it possible to use the device with tile of any size. A second key feature is a plurality of telescoping members that can be extended to varying lengths in order to describe the perimeter geometry that must be duplicated by cutting away a portion of the tile. The invention is compatible with all tile and similar flat floor or wall coverings, such as pavers or carpet squares.

BRIEF DESCRIPTION OF THE DRAWINGS

FIG. 1 is an oblique view of the present invention showing all probes extended.

FIG. 2 is an oblique view of the present invention showing all probes retracted.

FIG. 7 is an end view of a finger of the present invention.

FIG. 8 is a side view of a finger of the present invention.

FIG. 9 is a top view of a finger of the present invention.

FIG. 10A is a section view of FIG. 9 with probe retracted.

FIG. 10B is a section view of FIG. 9 with probe extended.

DETAILED DESCRIPTION OF THE INVENTION

Figure 3:
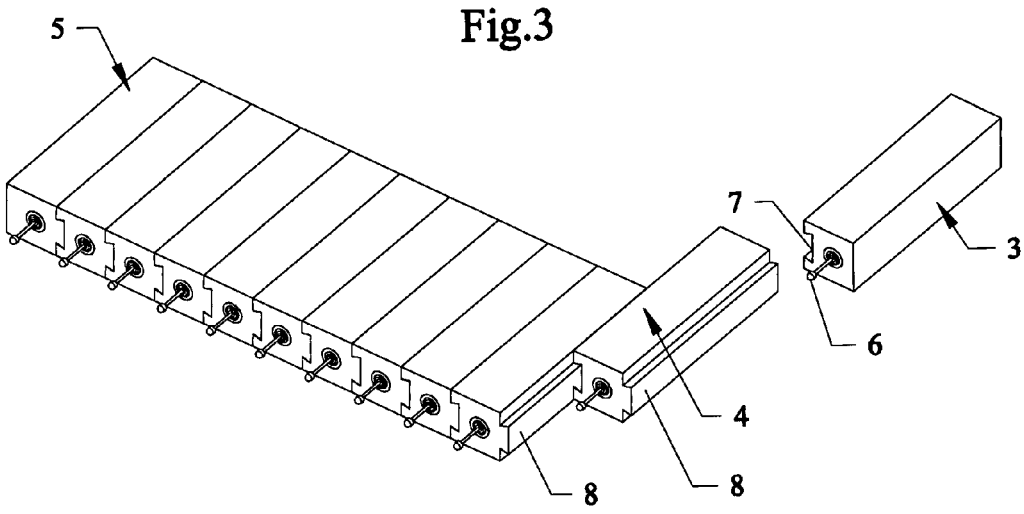
FIG. 3 is an oblique view of the present invention showing how individual fingers are connected.
Figure 4:
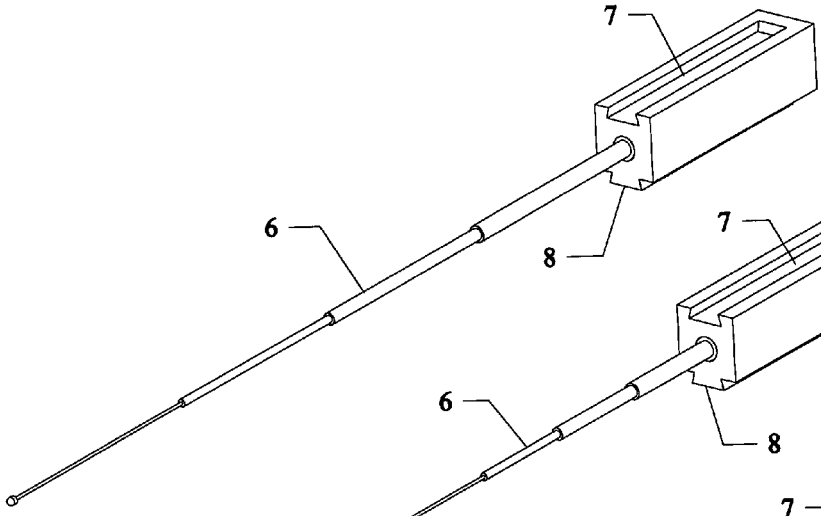
FIG. 4 is an oblique view of a finger of the present invention with probe fully extended.
Figure 5:
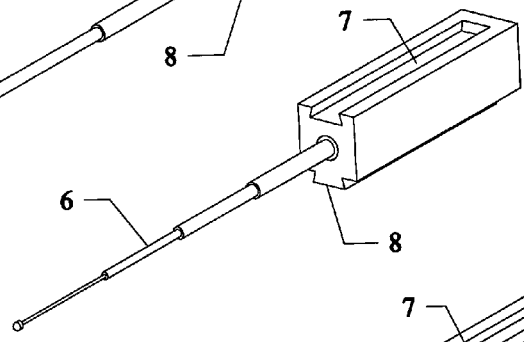
FIG. 5 is an oblique view of a finger of the present invention with probe partially extended.
Figure 6:
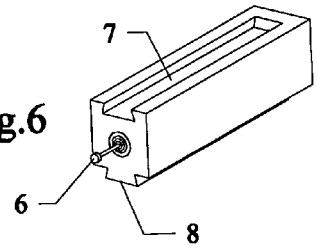
FIG. 6 is an oblique view of a finger of the present invention with probe fully retracted.
Figure 11:
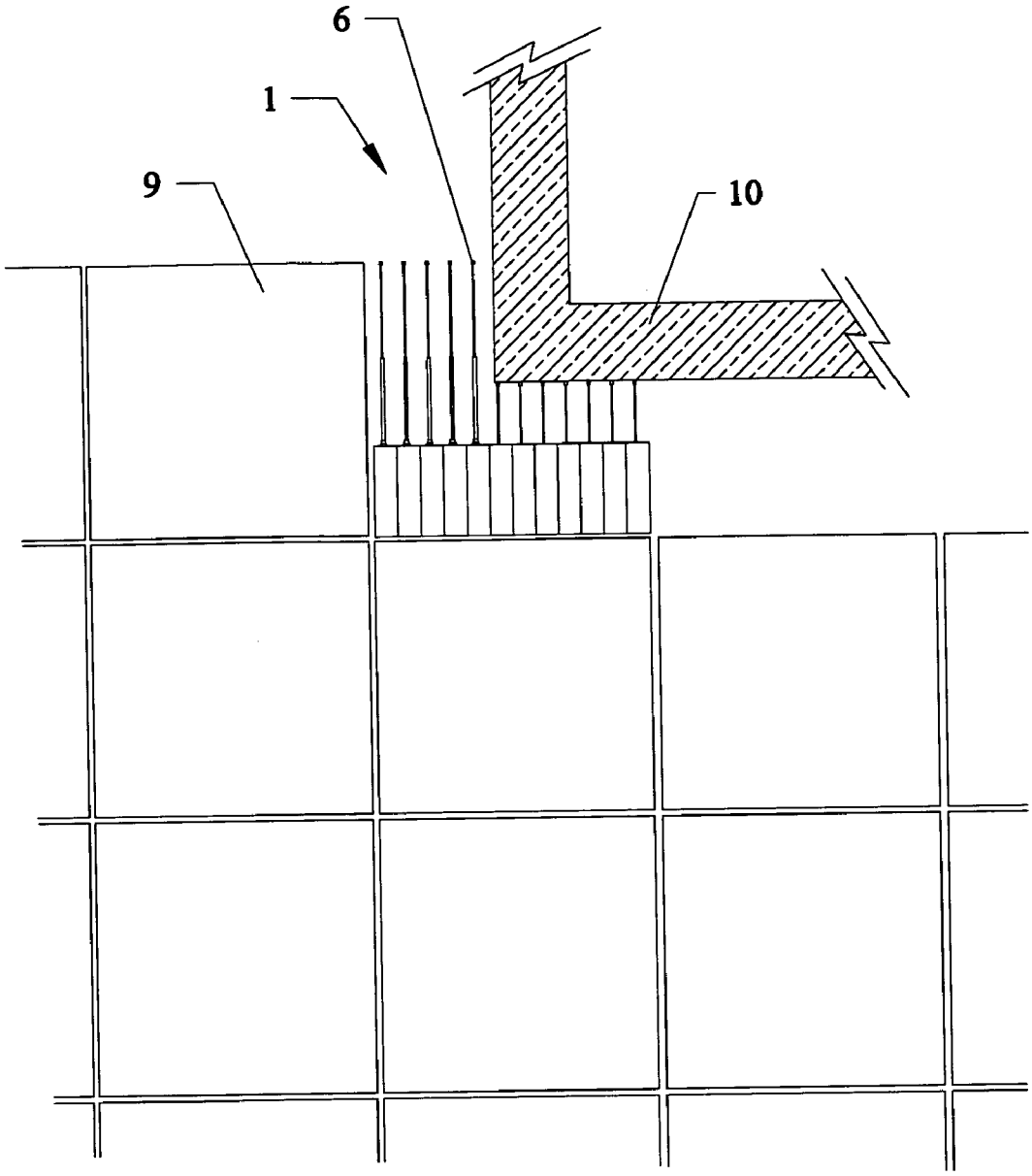
FIG. 11 is a view of the present invention being used around a corner of a wall.
Figure 12:
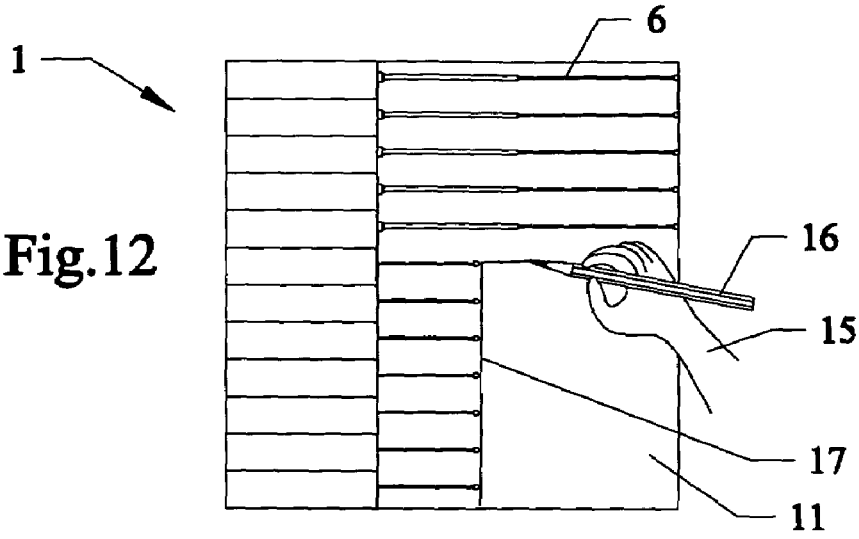
FIG. 12 is a view of the present invention translating the cut line from FIG. 11 to a tile.
Figure 13:
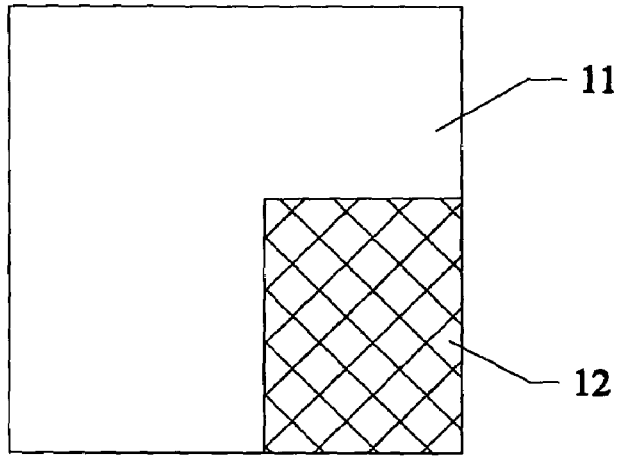
FIG. 13 shows the tile with cut line drawn and piece to be removed is hatched.
Figure 14:
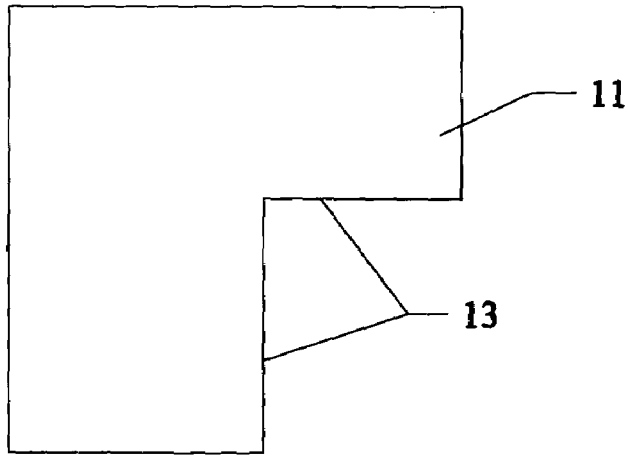
FIG. 14 shows the tile of FIG. 13 with piece removed.
Figure 15:
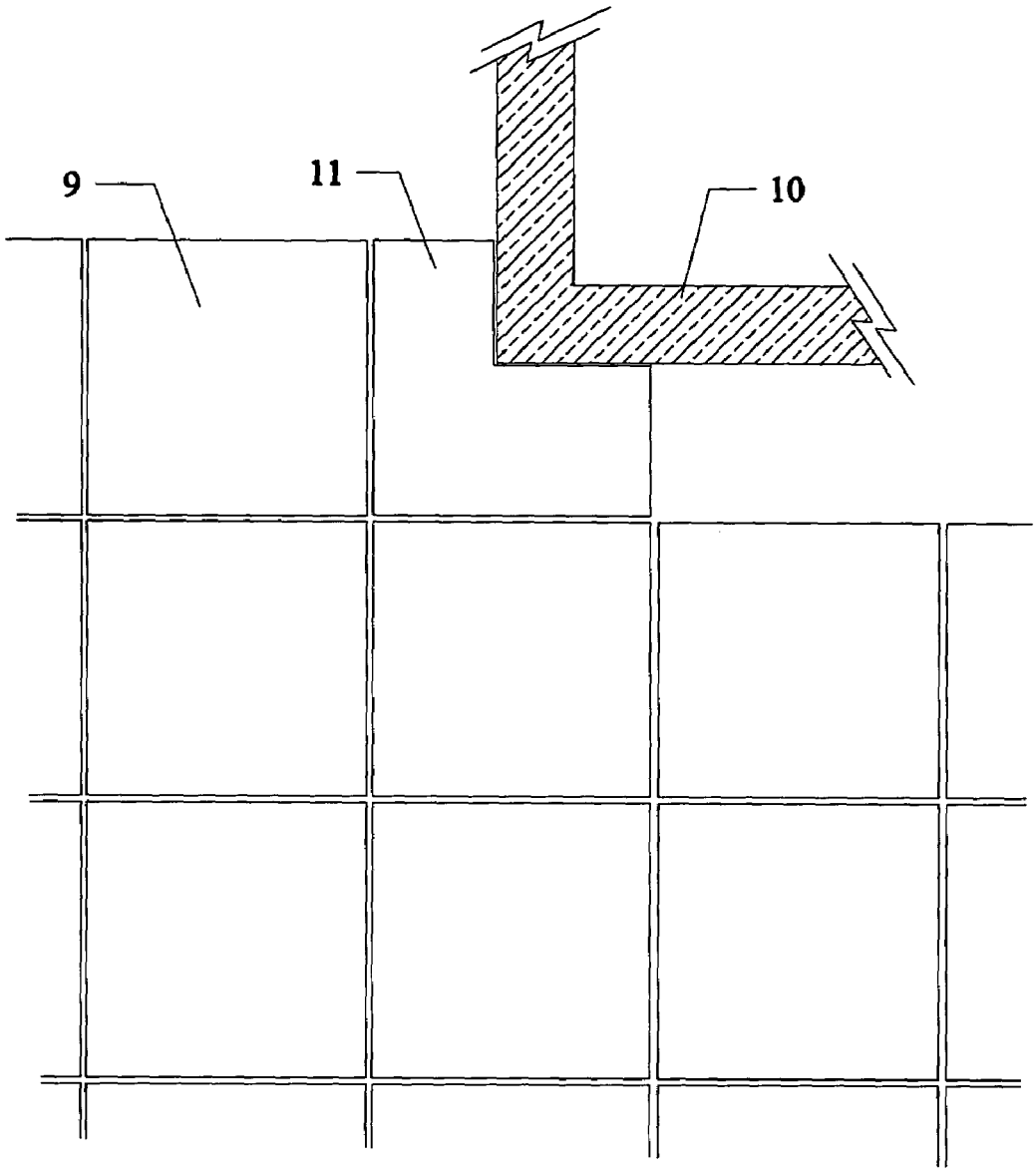
FIG. 15 shows the cut tile of FIG. 14 installed around a corner of a wall.
Figure 16:
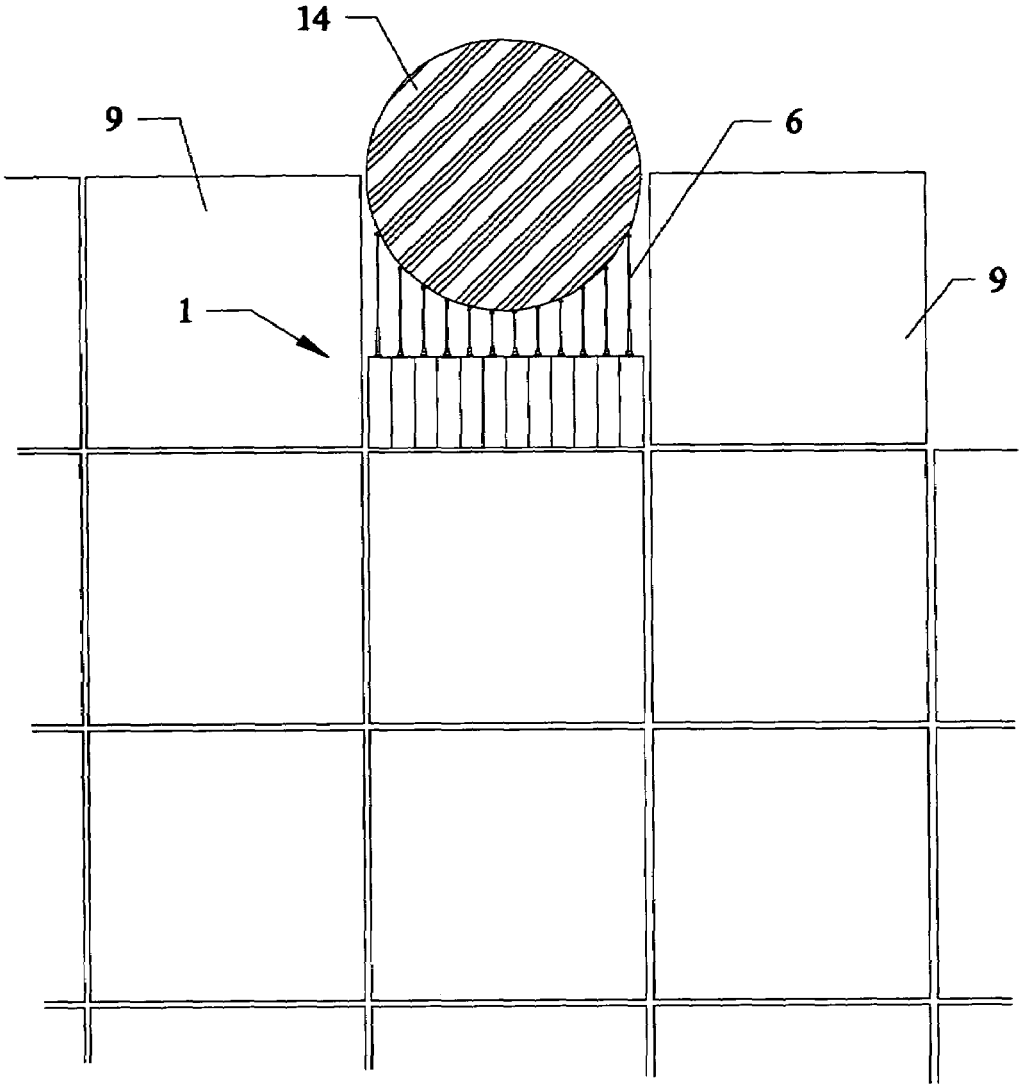
FIG. 16 is a view of the present invention being used around a column.
Figure 17:
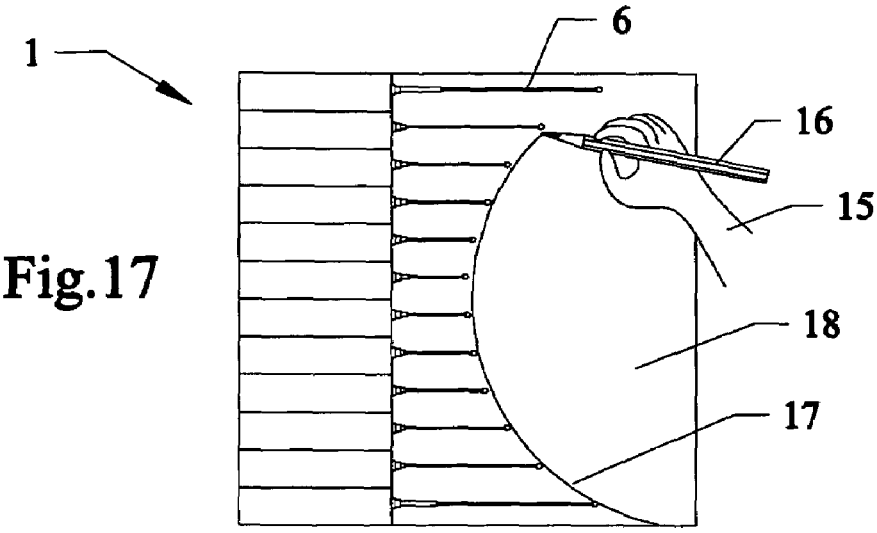
FIG. 17 is a view of the present invention translating the cut line from FIG. 16 to a tile.
Figure 18:
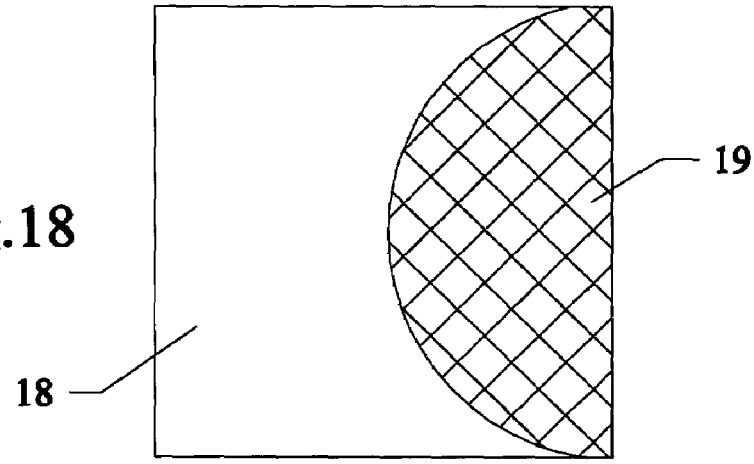
FIG. 18 shows the tile with cut line drawn and piece to be removed is hatched.
Figure 19:
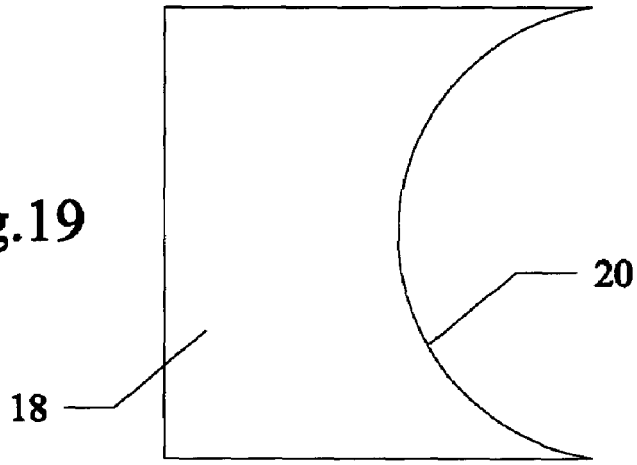
FIG. 19 shows the tile of FIG. 18 with piece removed.
Figure 20:
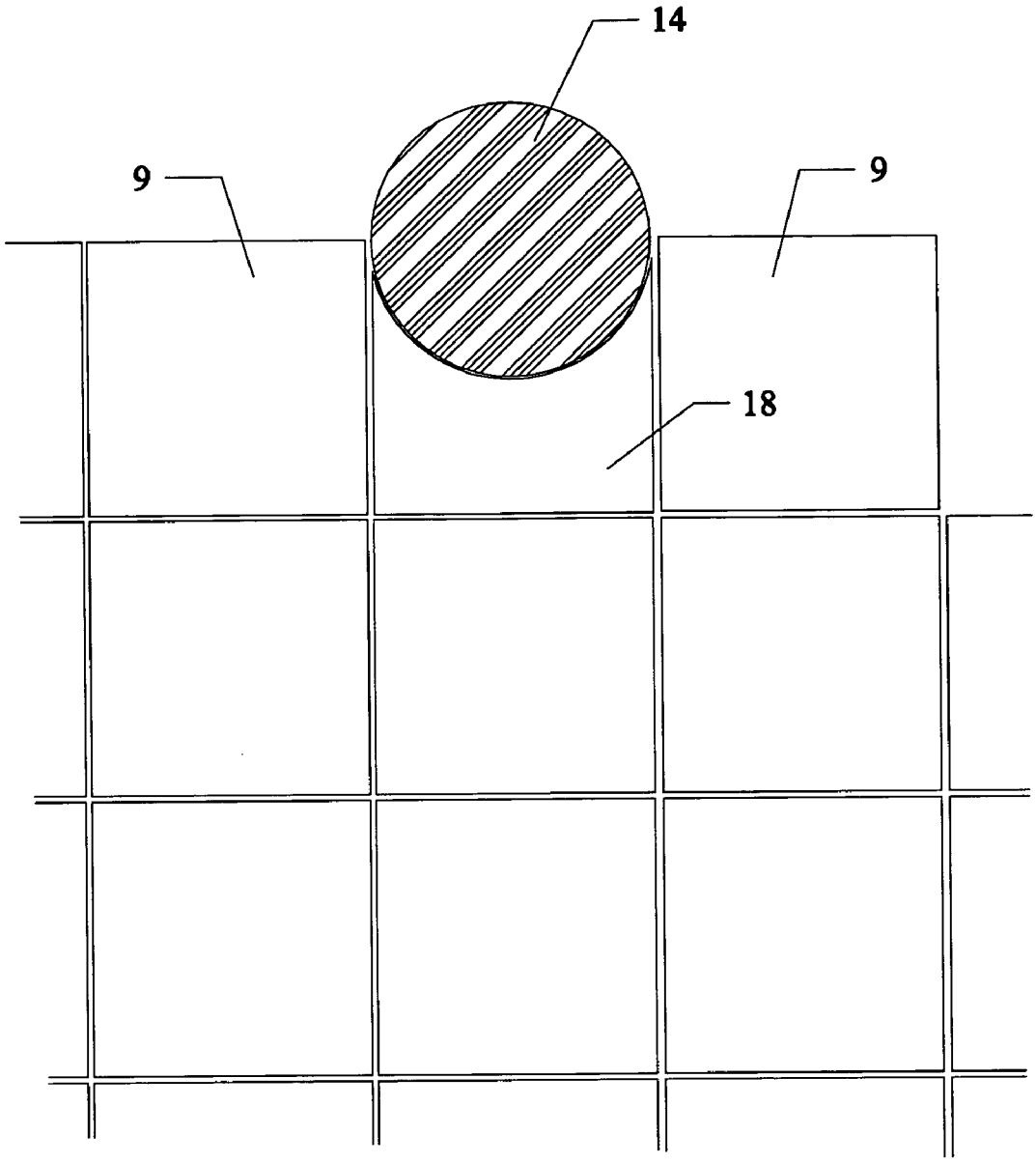
FIG. 20 shows the cut tile of FIG. 19 installed around a column.

With reference to FIGS. 1 through 20, marking tool 1 is comprised of one male end finger 5, a plurality of identical intermediate fingers 3, and a female end finger 3. Each of fingers 3, 4, and 5 are in the shape of an elongated, orthogonal, rectangular block. Five surfaces of each type of finger are of particular interest: the four long surfaces comprising the barrel of the block and one short surface on a first end of the block. Features on these five surfaces differentiate the three finger types. Fingers 3, 4, and 5 may be manufactured from wood, plastic, metal, composites or other typical structural materials.

Male end finger 5 includes a smooth planar first elongated surface 2, a smooth planar second elongated surface 22, and a smooth planar third elongated surface 23. Second surface 22 and third surface 23 are on opposite sides of male end finger 5. A fourth elongated surface 21 includes a male dovetail 8 extending from a first end surface 24 of the finger down a portion of the length of fourth surface 21. In the preferred embodiment, the ratio of male dovetail 8 length to fourth surface 21 length is in the range of about 50% and about 90%. In an alternate embodiment, male dovetail 8 extends down the entire length of fourth surface 21. First end surface 24 includes a perpendicular bore 25. Extendable probe 6 is integrally mounted inside bore 25. Extendable probe 6 can be retracted until flush with first end surface 24, or probe 6 may be extended in a telescoping fashion.

Female end finger 3 includes a smooth planar fourth elongated surface 21, a smooth planar second elongated surface 22, and a smooth planar third elongated surface 23. Second surface 22 and third surface 23 are on opposite sides of female end finger 3. A first elongated surface 2 includes a female dovetail groove 7 extending from a first end surface 24 of the finger down a portion of the length of first surface 2. In the preferred embodiment, the ratio of female dovetail groove 7 length to first surface 2 length is in the range of about 50% and about 90%. In an alternate embodiment, female dovetail groove 7 extends down the entire length of first surface 2. First end surface 24 includes a perpendicular bore 25. Extendable probe 6 is integrally mounted inside bore 25. Extendable probe 6 can be retracted until flush with first end surface 24, or probe 6 may be extended in a telescoping fashion.

Intermediate finger 4 includes a smooth planar second elongated surface 22, and a smooth planar third elongated surface 23. Second surface 22 and third surface 23 are on opposite sides of intermediate finger 3. A first elongated surface 2 includes a female dovetail groove 7 extending from a first end surface 24 of the finger down a portion of the length of first surface 2. In the preferred embodiment, the ratio of female dovetail groove 7 length to first surface 2 length is in the range of about 50% and about 90%. In an alternate embodiment, female dovetail groove 7 extends down the entire length of first surface 2. A fourth elongated surface 21 includes a male dovetail 8 extending from a first end surface 24 of the finger down a portion of the length of fourth surface 21. In the preferred embodiment, the ratio of male dovetail 8 length to fourth surface 21 length is in the range of about 50% and about 90%. In an alternate embodiment, male dovetail 8 extends down the entire length of fourth surface 21. First surface 2 and fourth surface 21 are on opposite sides of intermediate finger 3. First end surface 24 includes a perpendicular bore 25. Extendable probe 6 is integrally mounted inside bore 25. Extendable probe 6 can be retracted until flush with first end surface 24, or probe 6 may be extended in a telescoping fashion.

The tool is assembled for use by joining male dovetail 8 of male finger 5 with female dovetail groove 7 of an adjacent intermediate finger 4 into an integral assembly. Once firmly assembled in this manner, fourth surface 21 of male end finger 5 and first surface 2 of intermediate finger 4 are in contact with each other over their entire length. Additional intermediate fingers are added as required in the same manner by joining male dovetail 8 of one intermediate finger 5 with female dovetail groove 7 of an adjacent intermediate finger 4. Finally, in the same manner, the female dovetail groove 7 of female end finger 3 is attached to the male dovetail 8 of the last intermediate finger 5.

A key feature of the invention is that each parallel second surface 22 and third surface 23 on all fingers is exactly one inch in width. Thus, each time a finger is added to the assembly, the assembly grows in width by exactly one inch. The fingers must be assembled so that the overall width of the assembly is equal to the width of the tile. Thus, to accommodate a tile measuring four inches in width, the present invention must be assembled using one male end finger 5, two intermediate fingers 4, and one female end finger 3. To accommodate a tile measuring twelve inches in width, the present invention must be assembled using one male end finger 5, ten intermediate fingers 4, and one female end finger 3. There is no limit to the number of intermediate fingers 4 that can be added to the assembly.

Each finger includes a telescoping probe 6. Each probe is individually extendable. A typical maximum extension distance is twenty inches, corresponding to the typical maximum tile size that is readily available. Thus, twenty assembled fingers with their twenty probes extended describe a square footprint equal to twenty by twenty inches.

FIG. 11–FIG. 15 show a typical use of the present invention. Whole tiles 9 are installed on a floor until a permanent room feature such as wall 10 is approached. For each tile that must be cut, marking tool 1 is first placed upon the floor where the cut tile will ultimately be placed. Probes 6 are extended until they contact wall 10 or reach the maximum tile dimension. With probes 6 still extended, marking tool 1 is next placed upon a whole tile to be cut 11. The operator 15 uses a pencil or other device 16 to mark an outline 17 of the extended probes 6, thereby tracing the tile portion to be removed 12. A cutting device (not shown) can then be employed to make cuts 13 along outline 17. When the resulting cut tile 11 is placed on the floor, it fits around wall 10.

As shown in FIG. 16–FIG. 20, the marking tool 1 of the present invention can also be used to place tile around more complex permanent room features such as column 14. Ws before, whole tiles 9 are installed on a floor until a permanent room feature, such as column 14, is approached. Marking tool 1 is placed upon the floor where the cut tile will ultimately be placed. Probes 6 are extended until they contact column 14 or reach the maximum tile dimension. With probes 6 still extended, marking tool 1 is next placed upon a whole tile to be cut 18. The operator 15 uses a pencil or other device 16 to mark an outline 17 of the extended probes 6, thereby tracing the tile portion to be removed 19. A cutting device (not shown) can then be employed to make cuts 20 along outline 17. When the resulting cut tile 18 is placed on the floor, it fits around column 14.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A tile marking tool comprising an integral assembly of:

one male end finger, at least one intermediate finger, and a female end finger;

wherein said male end finger includes a planar first elongated surface, a planar second elongated surface, and a planar third elongated surface;

wherein said second surface and said third surface are on opposite sides of said male end finger, and wherein a fourth elongated surface includes a male dovetail extending from a first end surface of said male finger down a portion of the length of said fourth surface;

wherein said female end finger includes a planar fourth elongated surface, a planar second elongated surface, and a planar third elongated surface, wherein said second surface and said third surface are on opposite sides of said female end finger, and wherein a first elongated surface includes a female dovetail groove extending from a first end surface of said female finger down a portion of the length of said first surface;

wherein each said intermediate finger includes a planar second elongated surface, and a planar third elongated surface, wherein said second surface and said third surface are on opposite sides of said intermediate finger; wherein a first elongated surface includes a female dovetail groove extending from a first end surface of said intermediate finger down a portion of the length of said first surface, and wherein a fourth elongated surface includes a male dovetail extending from said first end surface of said intermediate finger down a portion of the length of said fourth surface;

wherein said first end surface of said male finger includes a perpendicular bore and an extendable probe is integrally mounted inside bore;

wherein said first end surface of said female finger includes a perpendicular bore and an extendable probe is integrally mounted inside bore.

2. A tile marking tool according to claim 1, wherein said tool is assembled for use by joining said male dovetail of said male finger with said female dovetail groove of an adjacent said intermediate finger into an integral assembly such that said fourth elongated surface of said male end finger and said first elongated surface of said intermediate finger are in contact with each other over their entire length, and wherein said female dovetail groove of said female end finger is attached to said male dovetail of the adjacent said intermediate finger into an integral assembly such that said fourth elongated surface of said intermediate finger and said first elongated surface of said female finger are in contact with each other over their entire length.

3. A tile marking tool according to claim 1, further comprising a plurality of intermediate fingers, wherein additional said intermediate fingers are added by joining said male dovetail of one said intermediate finger with said female dovetail groove of an adjacent intermediate finger prior to the step of attaching said female end finger to the finished assembly.

4. A tile marking tool according to claim 1, wherein said male end finger is one inch wide, and said female end finger is one inch wide, and said intermediate finger is one inch wide.

5. A tile marking tool according to claim 1, wherein the ratio of said male dovetail length to said fourth surface length on said male end finger is in the range of about 50% and about 90%; and wherein the ratio of said male dovetail length to said fourth surface length on said intermediate finger is in the range of about 50% and about 90%.

6. A tile marking tool according to claim 1, wherein the ratio of said female dovetail groove length to said first surface length on said female end finger is in the range of about 50% and about 90%; and wherein the ratio of said female dovetail groove length to said fourth surface length on said intermediate finger is in the range of about 50% and about 90%.

7. A tile marking tool according to claim 5, wherein the ratio of said female dovetail groove length to said first surface length on said female end finger is in the range of about 50% and about 90%; and wherein the ratio of said female dovetail groove length to said fourth surface length on said intermediate finger is in the range of about 50% and about 90%.

* * * * *